United States Patent [19]

Biondo

[11] 3,998,487

[45] Dec. 21, 1976

[54] DEVICE FOR THE AUTOMATIC RELEASE OF A CHAIN

[76] Inventor: Nunzio Biondo, Via Pasubio 21, Cecina (Leghorn), Italy

[22] Filed: Nov. 28, 1975

[21] Appl. No.: 635,866

[30] Foreign Application Priority Data

Dec. 12, 1974 Italy ..... 13088/74

[52] U.S. Cl. ..... 294/83 R; 294/75; 24/241 PL

[51] Int. Cl.[2] ..... B66C 1/38

[58] Field of Search ..... 294/83 R, 84, 82, 75, 294/83 A, 83 AB; 230/230.5 SA, 230.5 AC, 230.5 LH, 230.5 CR, 230.5 S, 230.5 TH, 230.5 R, 230.5 SS, 230.5 BA, 230.5 AD, 230.5 BH, 230.5 CS, 230.5 W, 232, 241 PL, 241 P, 241 PP, 241 PS, 241 SP, 232 G, 241 TC, 242; 59/85, 86, 88, 89, 93

[56] References Cited

UNITED STATES PATENTS

| | | | |
|---|---|---|---|
| 267,089 | 11/1882 | Leirmann | 24/241 PL |
| 992,746 | 5/1911 | Ashdown | 294/83 R |

FOREIGN PATENTS OR APPLICATIONS

| | | | |
|---|---|---|---|
| 163,290 | 4/1965 | U.S.S.R. | 294/32 R |

*Primary Examiner*—James B. Marbert
*Attorney, Agent, or Firm*—Robert E. Burns; Emmanuel J. Lobato; Bruce L. Adams

[57] ABSTRACT

The invention provides a device by means of which the end of a chain may be suspended to a suspending means and then released automatically from said suspending means after the load has reached the relevant resting floor.

2 Claims, 5 Drawing Figures

FIG. 3
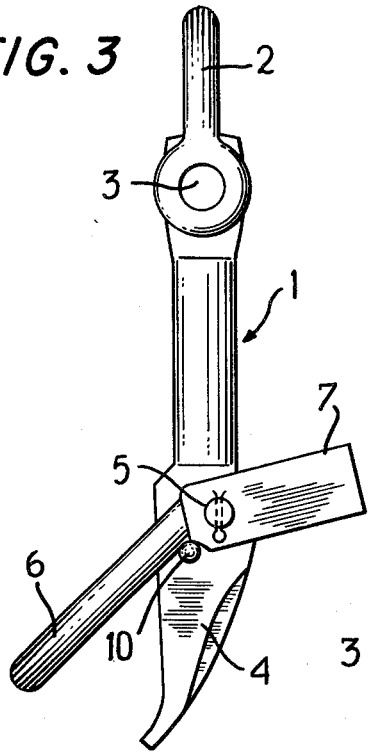
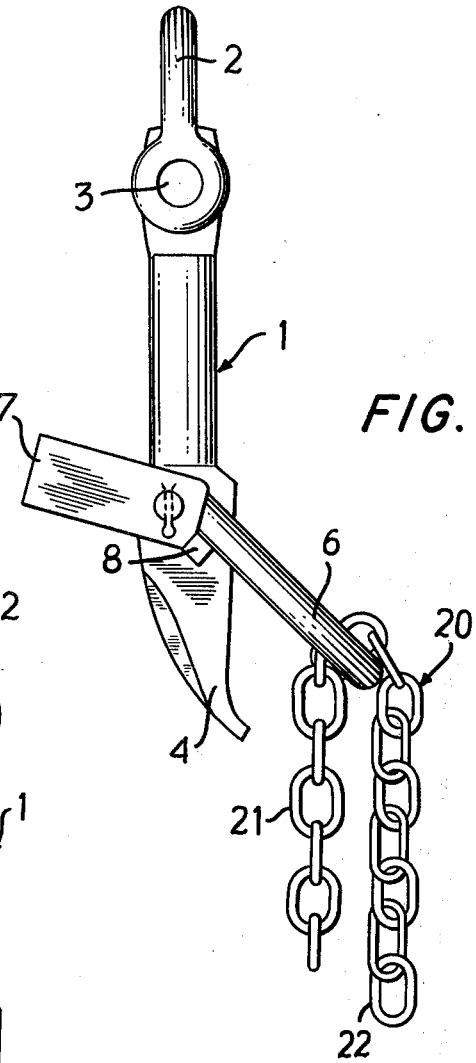
FIG. 4
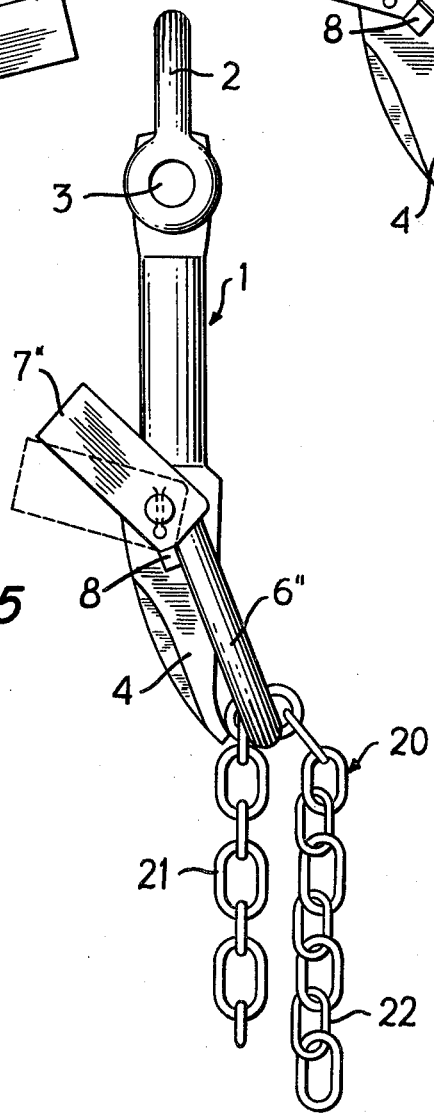
FIG. 5

DEVICE FOR THE AUTOMATIC RELEASE OF A CHAIN

BACKGROUND OF THE INVENTION

The present invention relates to an improved device for the automatic release of a chain.

A device for the automatic release of a chain is particularly useful when bundles of sections are to be placed onto the bottom of ship holds, on railway cars and so on, in fact, when said section bundles are placed onto the discharge floor, it is possible that, after releasing the chain keeping together said bundle, the individual sections may be subject to movements which are very dangerous for the operators taking care of the release of the chain.

OBJECT OF THE INVENTION

The invention, in view of the foregoing, aims at removing the above drawbacks, avoiding any danger for the operators taking care of the chain release.

SUMMARY OF THE INVENTION

The improved device for the automatic release of a chain according to the invention comprises a body provided on top with engaging means and on the bottom with a pin for the ends of the arms of a U-shaped bracket and for a counter weight; wherein said body below said pin has the shape of a widened arm whose profile crosses the inner proficel of said bracket which, owing to its own weight, tends to rest against said arm; wherein further said counter weight is provided with at least a catch tooth for keeping lifted, in an open position with respect to said arm, the bracket; wherein finally is provided a king bolt sliding in a hole in said arm and elastically pushed to project from the arm surface so as to form a disengageable support abutment suitable to prevent the bracket from closing on said arm.

Said body is further provided with a catch means for preventing said counter weight from being subject to a rotation larger than a pre-fixed limit under the action of its weight only.

BRIEF DESCRIPTION OF THE DRAWINGS

In order that the invention may be clearly understood, it will now be described, by way of example, with reference to the accompanying drawings, wherein:

FIG. 3 is a view of said device symmetric with respect to FIG. 1, showing the second side thereof;

FIG. 4 is a view similar to FIGS. 1 and 3, showing said device still in open position, with the chain inserted therein;

FIG. 5 is a view of the device profile with the chain inserted, the device being here in closed position.

DESCRIPTION OF A PREFERRED EMBODIMENT

Figure 1:
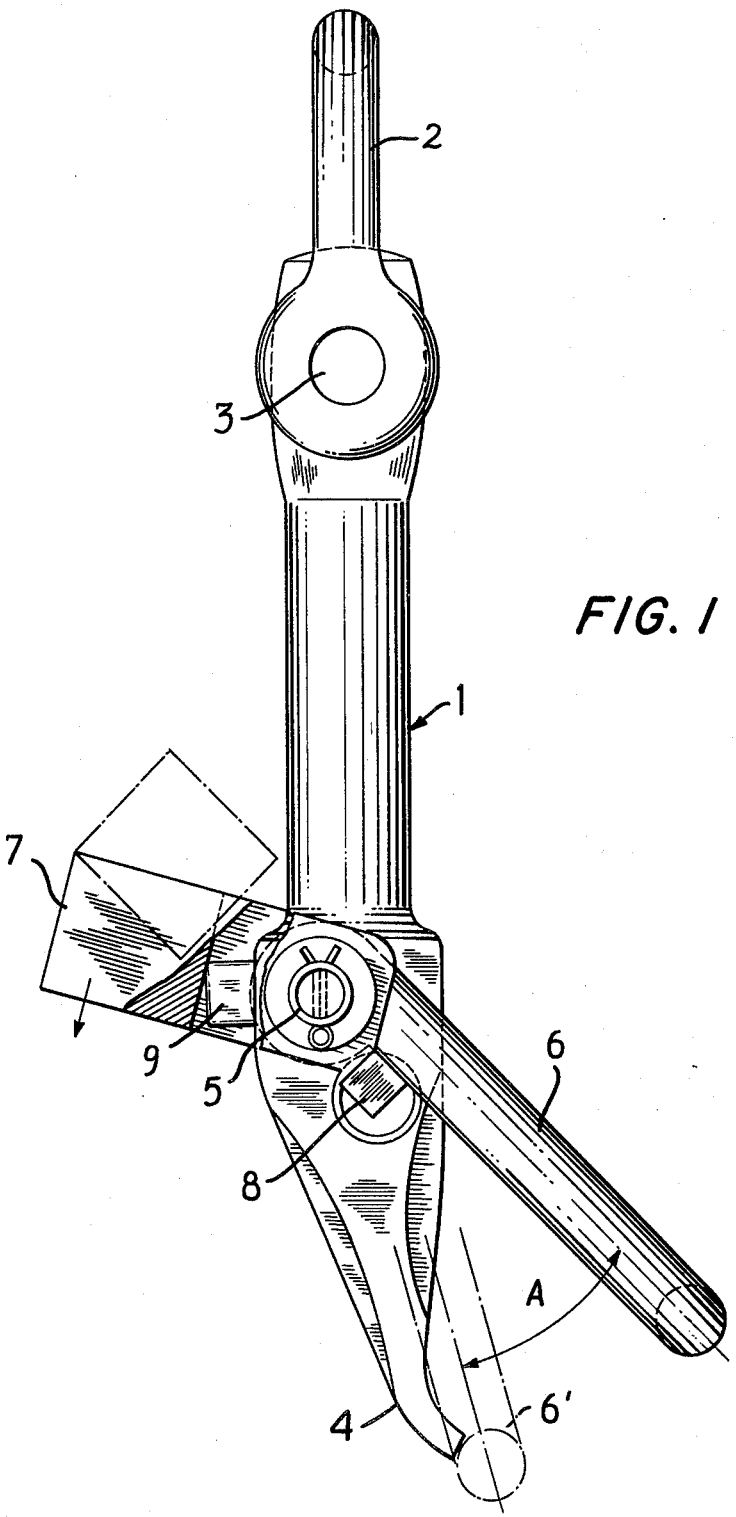
FIG. 1 is a side view of the device in open position, according to a preferred embodiment of the invention.
Figure 2:
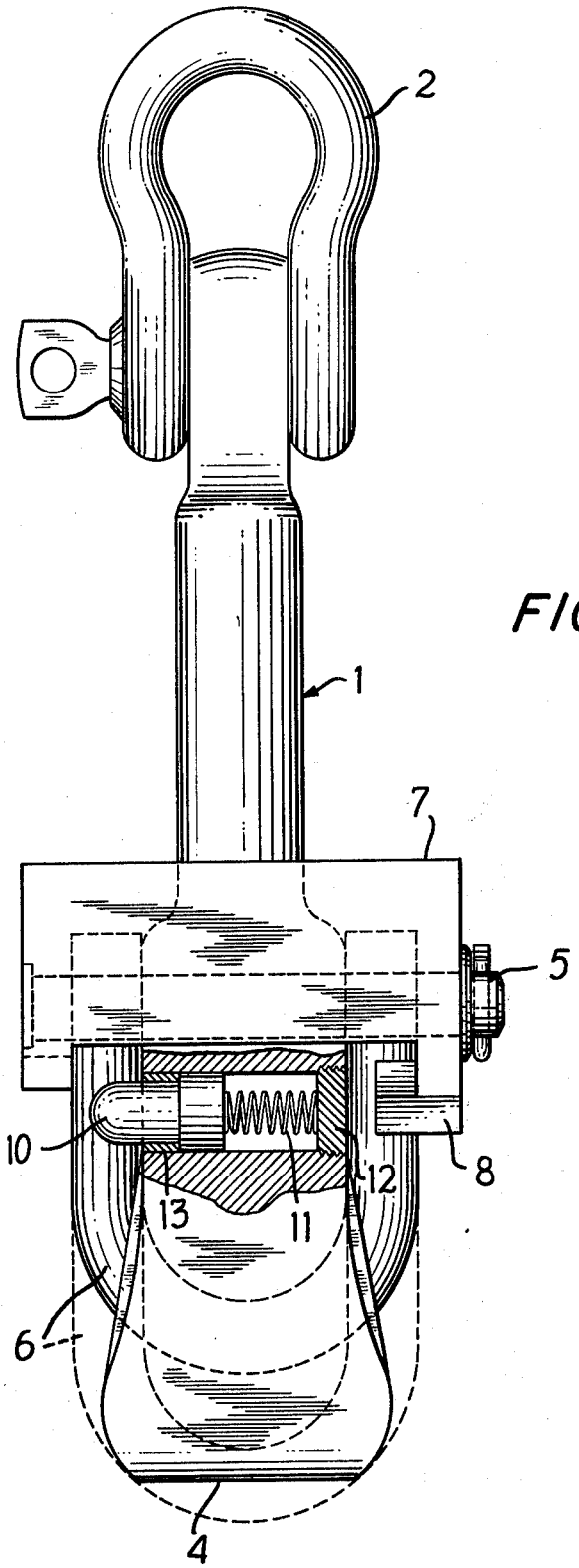
FIG. 2 is a forward view of said device still in open position.

The device claimed comprises a body 1 which is suspended on top in an articulated way to a shackle 2 through a pin 3. Said shackle 2 may be suspended in known manner to any suspending means, for instance a crane hook. At its bottom said body 1 is flattened in form of a widened arm 4 whose upper end is defined by a hole in said body 1, housing an articulation pin 5.

Said pin 5 is connected, in an articulated manner, to a U-shaped bracket 6 whose inner profile crosses the outer profile of said arm 4, and thus said bracket 6 rests, in abutting position, onto the end of said arm 4 when is left free under the action of its weight, as shown by a dotted line in FIG. 1, numbered 6'.

Around pin 5 is articulated a counter weight 7 which, correspondingly to one of its ends, is provided with a tooth projecting inwards so as to interfere with the projection of the outer profile of bracket 6. Said tooth 8 is arranged so as to strike the lower face of bracket 6, so as to keep the latter lifted in the position shown by a continue line in FIG. 1.

An abutment 9, projecting from the back of the lower end of said body 1, prevents the counter weight tilting angle from overpassing an established maximum level corresponding to an opening angle (A) suitable for said bracket 6. Below the hole of pin 5 a second hole parallel to the first one is provided on the upper end of arm 4. In said second hole may slide a king bolt 10 whose axis is substantially aligned to the axis of tooth 8, but is arranged on the opposite side with respect to said arm 4.

Said king bolt 10 comprises a semi-spheric end followed by a cylindric portion and is pressed outside its housing hole by a spring 11 which at the other end rests against a threaded plug 12. A bush 13, forced into said hole 9 prevents spring 11 from pushing said king bolt 10 completely outside.

Angle A is obviously large enough as to allow the passage of the chain the device according to the invention is provided for.

The device works as follows: in the position shown by a continue line in FIG. 1, bracket 6 is kept open by both counter weight 7, through tooth 8, and king bolt 10 whose cylindric portion supports one of the arms of said bracket 6.

For moving the device in the operative position, an operator inserts a number of links of a chain 20 (FIG. 4) into bracket 6, so as the end or top 21 of chain 20 may remain between bracket 6 and arm 4. The second branch 22 of said chain, still free, is then connected to the load to be lifted. Now, the operator depresses partially the end of said king bolt 10 so as the weight of the chain arranged over said bracket 6, having a moment of opposite sign and absolute value higher than that caused by counter weight 7, causes the bracket to rotate and consequently, through said tooth 8, the counter weight to rotate to positions 7'' and 6'' shown in FIG. 5.

In such a position the lower end or edge of arm 4 will strike the first link of the chain portion 21 preventing chain 20 from sliding in bracket 6 to the direction of load P. Therefore, through said shackle 2 it will be possible to lift and move the chain device and the underlying load, not shown, to the discharge place.

Once the load, e.g. a bundle of sections, rests onto a discharge floor, the device with chain 20 is lowered to the point when the lower end of bracket 6 rests onto the load concerned or anyhow onto any solid and stationary surface; at this moment the bracket 6 receives a push upwards cooperated by counter weight 7 which is in position to overpass the moment generated by the few chain links now suspended to bracket 6.

When under these two combined actions the opening angle reaches a value close to (A), said king bolt 10 pushed by spring 11 enters under bracket 6, cooperating to the action of counter weight 7, by lifting the whole formed by the device and chain, bracket 6 will remain open owing to said king bolt 10 and said chain 20 will slip off automatically from said bracket 6.

It is to be understood that the invention is not limited to the examples shown. It is intended to cover all modifications within the scope of the appended claims.

What I claim is:

1. An improved device for the automatic release of a chain comprising a body provided on top with hooking means and on the bottom with an articulation pin for the ends of the arms of a U-shaped bracket and for a counterweight; wherein said body has below said pin a widened arm whose profile crosses the inner profile of said bracket which, due to its own weight, tends to rest against said arm; wherein further said counter weight is provided with at least an abutting tooth for keeping lifted, in open position with respect to said arm, said bracket; wherein finally is provided a king bolt slidable in a hole in said arm and elastically pushed to project from the arm surface so as to provide a disengageable supporting abutment suitable to prevent said bracket from closing on said arm.

2. The device according to claim 1, wherein said body is provided with an abutting means suitable to prevent said counter weight from being subject, under the action of its own weight only, to a rotation greater than a pre-fixed value.

* * * * *